US009789377B2

(12) United States Patent
Branch

(10) Patent No.: US 9,789,377 B2
(45) Date of Patent: Oct. 17, 2017

(54) ACCURACY BALL

(71) Applicant: Donell Branch, Colorado Springs, CO (US)

(72) Inventor: Donell Branch, Colorado Springs, CO (US)

( * ) Notice: Subject to any disclaimer, the term of this patent is extended or adjusted under 35 U.S.C. 154(b) by 106 days.

(21) Appl. No.: 15/059,315

(22) Filed: Mar. 3, 2016

(65) Prior Publication Data

US 2016/0175678 A1 Jun. 23, 2016

Related U.S. Application Data

(63) Continuation-in-part of application No. 14/253,620, filed on Dec. 22, 2014, now abandoned.

(51) Int. Cl.
*A63B 69/32* (2006.01)
*A63B 69/20* (2006.01)
(Continued)

(52) U.S. Cl.
CPC ..... *A63B 69/32* (2013.01); *A63B 69/004* (2013.01); *A63B 71/0622* (2013.01); *A63B 71/08* (2013.01); *A63B 2071/0625* (2013.01); *A63B 2071/0694* (2013.01); *A63B 2209/10* (2013.01); *A63B 2220/12* (2013.01);
(Continued)

(58) Field of Classification Search
CPC ..... A63B 43/02; A63B 69/004; A63B 69/20; A63B 69/24; A63B 69/26; A63B 69/32; A63B 69/325; A63B 69/34; A63B 71/0622; A63B 71/0694; A63B 71/08; A63B 71/14; A63B 71/141; A63B 71/145; A63B 2071/0625; A63B 2209/10; A63B 2220/12; A63B 2220/17; A63B 2220/40; A63B 2220/53; A63B 2220/72; A63B 2220/74; A63B 2220/75; A63B 2220/801; A63B 2225/50; A63B 2244/10; A63B 2244/102; A63B 2244/104; A63B 2244/106; A63B 2244/108
See application file for complete search history.

(56) References Cited

U.S. PATENT DOCUMENTS 3,185,476 A * 5/1965 Fechner ..... A63B 43/02 2/18
D515,652 S * 2/2006 McCreath ..... D21/787
(Continued)

*Primary Examiner* — Joshua Lee

(57) ABSTRACT

An accuracy ball has a target strike cover, sensors, grips, and a data core that function in combination to provide a device that a trainer can hold and a fighter can practice striking accurately. The accuracy ball has target aim points that a user attempts to strike. The ball can gather data concerning the user's performance during a workout, including strike: accuracy/precision, strength/force, number and velocity, etc. The target strike cover can provide cushioning, as needed. Internal grasp handles allow the accuracy ball to be held safely by providing protection from errant strikes. Sensors including force plates, accelerometers, gyroscopes, location sensing, temperature, pressure, humidity, etc. can all be incorporated. On/off switch, IO port (such as micro-USB), wireless communication devices, display screen, control switches, etc. can be integrated therein as well. Exported data can be tracked, analyzed, graphed, and used to enhance learning and improve skill-sets.

20 Claims, 9 Drawing Sheets

(51) Int. Cl.

| | |
|---|---|
| ***A63B 69/22*** | (2006.01) |
| ***A63B 69/24*** | (2006.01) |
| ***A63B 69/26*** | (2006.01) |
| ***A63B 69/00*** | (2006.01) |
| ***A63B 71/06*** | (2006.01) |
| ***A63B 71/08*** | (2006.01) |

(52) U.S. Cl.
CPC ..... *A63B 2220/17* (2013.01); *A63B 2220/40* (2013.01); *A63B 2220/53* (2013.01); *A63B 2220/72* (2013.01); *A63B 2220/74* (2013.01); *A63B 2220/75* (2013.01); *A63B 2220/801* (2013.01); *A63B 2225/50* (2013.01)

(56) References Cited

U.S. PATENT DOCUMENTS

| | | | | |
|---|---|---|---|---|
| 8,382,647 | B1 * | 2/2013 | Hodes | A63B 21/072<br>482/108 |
| 9,091,504 | B2 * | 7/2015 | McDonald | F41B 15/00 |
| 2003/0134727 | A1 * | 7/2003 | Yu | A63B 21/0004<br>482/110 |
| 2004/0220022 | A1 * | 11/2004 | McCreath | A63B 69/004<br>482/83 |
| 2005/0250627 | A1 * | 11/2005 | Park | A63B 21/06<br>482/93 |
| 2005/0277498 | A1 * | 12/2005 | Chen | A63B 41/00<br>473/576 |
| 2013/0296141 | A1 * | 11/2013 | Partlo | A63B 69/34<br>482/84 |
| 2015/0057131 | A1 * | 2/2015 | Manley | A63B 69/004<br>482/83 |

* cited by examiner

ACCURACY BALL

CROSS REFERENCE TO RELATED APPLICATIONS

This application claims the benefit of U.S. patent application Ser. No. 14/253,620 entitled THE ACCURACY BALL and filed on Dec. 22, 2014, which is specifically incorporated by reference herein for all that it discloses and teaches.

TECHNICAL FIELD

The present invention relates generally to the field of sports; more particularly, to physical contact sports such as martial arts, boxing, etc.; and more particularly still, to a training and exercise device that develops a user's striking accuracy.

BACKGROUND

For as long as hand-to-hand combat, martial arts, boxing, and related contact sports have been around, humans have used equipment to help them train, practice and develop skills related to those sports. Common and rather ubiquitous examples of such equipment include the myriads of punching bags that have been developed. However, most such bags provide only a generally "dumb", un-precise target for a person to strike. Large hanging bags, for example, can be struck using fists, elbows, knees, feet, and various other body parts, in order to practice using one's body to strike. But such bags usually do not provide exact strike aiming points or track the accuracy, force, and precision of strikes. Further, such data isn't logged or used to provide post-workout analysis or real-time feedback during the workout/training session.

What is needed is a device that provides a plurality of target aim points that a user can practice striking accurately. The device should be relatively small and portable so that a trainer or other helper can safely hold and manipulate the device in order to help the user to train under more real-world conditions. Further, the device should be able to gather data concerning the user's performance during the training/workout/practice session; such data can include accuracy and precision of strikes, strength or force of strikes, number and speed and/or velocity of strikes, etc.

SUMMARY

One embodiment of an accuracy ball comprises a target strike cover, sensors, and data collection and processing core that function in combination to meet the needs described above. The target strike cover can provide a plurality of specific target aim points so that a user can focus in on precise aiming of his or her strikes. Additionally, the target strike cover can provide impact absorption and/or cushioning. Inside the accuracy ball is a cavity that provides grasp handles so that a trainer or helper can hold the accuracy ball while his or her hands, etc. are protected from errant strikes by the user. Trainer is defined herein to include the traditional sports trainer as well as any other training helper, be it a person, machine, device, etc. Additionally, a plurality of sensors and electronics can be incorporated therein to gather data concerning the user's performance during a training/workout/practice session; such data can include accuracy and precision of strikes, strength or force of strikes, number and speed and/or velocity of strikes, etc. Sensors such as force plates, accelerometers, gyroscopes, location sensing (possibly including GPS), temperature, pressure, humidity, etc. can all be incorporated. Force plates are defined herein to include any sensor which can sense movement, velocity, acceleration, etc. User input/outputs should be incorporated, such as on/off switch, IO port (such as micro-USB), wireless communication devices, display screen, control switches, etc. Such devices can be voice-activated, manual, or remote operated. The various electronics should present relatively simple options and interface(s) as the interior cavity of the accuracy ball may not have excess space to adequately present complex options/interfaces and inadvertent interaction with controls/electronics should be minimized. Notwithstanding the above, wired or wireless interfaces with external devices can be extremely complex and robust so as to consistently report any and/or all data gathered by the accuracy ball.

DETAILED DESCRIPTION

Figure 1:
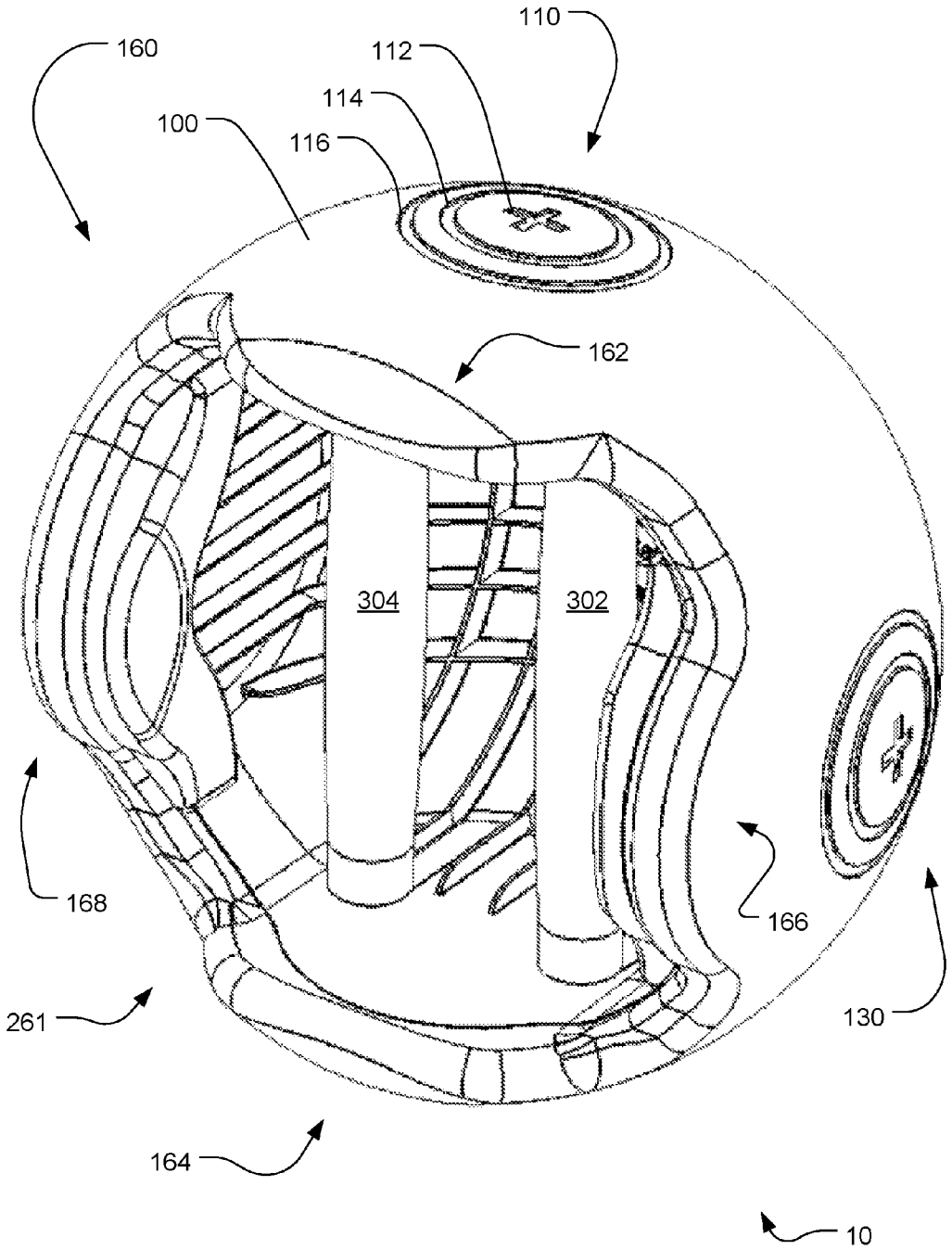
FIG. 1 illustrates a top and front perspective view of an exemplary embodiment of an accuracy ball.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples.

Exemplary embodiments are described below in the accompanying Figures. The following detailed description provides a comprehensive review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Referring now to the drawings, FIG. 1 illustrates a top and front perspective view of an exemplary embodiment of an accuracy ball 10. In the embodiment illustrated in FIG. 1, the accuracy ball is generally ball-like or spherical with a trainer access port 160. In other embodiments, other shapes are contemplated. Regardless of the outer shape, an accuracy ball 10 should have an outer component comprising a target strike cover 100. In other embodiments, additional coverings may be added over top of the target strike cover 100 such that the target strike cover 100 is no longer the most outer component (although it can still be considered an outer component).

The target strike cover 100 functions to provide specific target aim points for a user's strikes as well as potentially providing cushioning and/or impact absorption. In some embodiments, especially if the user is utilizing gloves, pads, etc., less impact absorption is generally needed and the target strike cover 100 can provide little to no cushioning. In other embodiments, especially if the user is not utilizing any gloves, pads, etc., more impact absorption is useful and the target strike cover 100 can provide additional cushioning. Regardless of the particular level of cushioning, the target strike cover 100 should indicate specific target aim points. In the embodiment in FIG. 1, a plurality of target aim points 110 and 130 are illustrated. Any useful target aim point shapes/designs can be utilized without departing from the scope of the invention. In the embodiment illustrated in FIG. 1, top target aim point 110 utilizes a plus sign to indicate the first main aim 112 of the top target aim point 110, with a first plurality of centering rings 114 and 116 there around.

In the embodiment illustrated in FIG. 1, the accuracy ball 10 is generally ball-like or spherical with a first trainer access port 160. In other embodiments, other shapes are contemplated. The trainer access port 160 provides access to the interior of the accuracy ball 10. The first trainer access port 160 bridges or joins the external surface with the internal surface of the target strike cover. The perimeter of the first trainer access port 160 is therefore those portions of the external surface and internal surface immediately surrounding the interface between the external and internal surfaces. Inside the accuracy ball, a plurality of impact handles can be incorporated so that a trainer (defined herein to include the traditional sports trainer as well as any other training helper, be it a person, machine, device, etc.) can grasp onto the accuracy ball 10 and hold it for the user. In the embodiment illustrated in FIG. 1, a plurality of impact handles 302 and 304 are shown. The plurality of impact handles 302 and 304 can number 1, 2, or more. In other embodiments, the plurality of impact handles 302 and 304 can be adapted to provide a mounting location for a helper device (defined as another type of trainer) to grasp onto the accuracy ball 10 and present it to the user. Such a trainer can be static—for example, mounted to a wall—or it can be dynamic and mounted to a moving device. The moving device can be as simple as a spring arm which allows the accuracy ball 10 to react to impacts, a moving arm that moves the accuracy ball 10 according to predetermined patterns or chaotically, or something complex such as a robot that approximates a human trainer.

The plurality of impact handles 302 and 304 can be mounted to the surfaces that define an inner cavity 261 of an accuracy ball support structure 200 (see FIG. 8) for the accuracy ball 10. In other embodiments, the support structure is built into the target strike cover 100 and so the plurality of impact handles 302 and 304 can be mounted directly to the target strike cover 100 in those embodiments.

A plurality of keeper lips 162, 164, 166, and 168 comprise at least a portion of the perimeter of the trainer access port 160. The plurality of keeper lips 162, 164, 166 and 168 can have lips, or other fastening devices, which wrap around a perimeter of a second trainer access port 260 (see FIG. 8) in order to secure the accuracy ball support structure 200 within the target strike cover 100. The second trainer access port 260 comprises a port in the accuracy ball support structure 200 through which a trainer can access the interior cavity 261 of the accuracy ball. The second trainer access port 260 bridges or joins the outer surface of the accuracy ball support structure with the inner surface thereof. The perimeter of the second trainer access port 260 is therefore those portions of the outer surface and inner surface of the support structure 200 immediately surrounding the interface between the outer and inner surfaces.

The first and second trainer access ports 160 and 260 should at least partially align so that the trainer can reach through the ports to grasp an internal portion of the accuracy ball 10 in such a way as to not leave his or her hands exposed to any potentially misplaced strikes of the user. The plurality of keeper lips 162, 164, 166 and 168 as illustrated in the embodiment shown in FIG. 1 surround the perimeter of the second trainer access port 260 and secure the accuracy ball support structure 200 within the target strike cover 100. In other embodiments, other means of securing the two are contemplated. For example, rivets, pins, hook-and-loop materials, snaps, zippers, screws, bolts, adhesives, or other fasteners can be utilized to securely hold the support structure 200 to the target strike cover 100.

When in place, at least a portion of the outer surface of the support structure 200 can be either removably attached or affixed to at least a portion of the internal surface of the target strike cover 100. In other embodiments, the two surfaces are secured against one another over a significant proportion of their surface areas.

No sensors or electronics are obviously visible in the embodiment shown in FIG. 1. For a depiction of the data collection and processing core containing at least some of the electronics, see FIG. 2, item 400. The core 400 can incorporate a plethora of electronics and sensors, including force plates, accelerometers, gyroscopes, location sensing (possibly including GPS), temperature, pressure, humidity, etc. can all be incorporated. User input/outputs can also be included, such as an on/off switch, IO port (such as micro-USB), wireless communication devices, display screen, control switches, etc. Such devices can be voice-activated, manual, or remote operated. The various electronics should present relatively simple options and interface(s) as the interior cavity 261 of the accuracy ball may not have excess space to adequately present complex options/interfaces, and inadvertent interaction with controls/electronics should be minimized. Notwithstanding the above, wired or wireless interfaces with external devices can be incorporated in the core 400 and such can be extremely complex and robust so as to consistently report any and/or all data gathered by the accuracy ball 10. Additional sensors can be located throughout the accuracy ball 10. For example, a plurality of impact sensor plates 210, 220, 230, and 240 can be incorporated in the accuracy ball support structure 200 (see FIG. 8). Such impact sensor plates can sense the location, force, speed, force and/or direction of impacts.

In one exemplary embodiment, a data collection and processing core 400 is attached to at least one of the support structure, impact handles, and the target strike cover. The core has at least a processor, a data receiving device and a data transmission device. A plurality of sensors selected from at least force plates and accelerometers is configured to gather data concerning any strikes sustained by the accuracy ball. The plurality of sensors are in electronic communication with the data receiving device so that any data sensed can be sent to and gathered by the data receiving device. The processor can be configured to process data from the data collection device. The processor is in electronic communication with the data transmission device so that it can communicate either (or both) raw data gathered from the sensors or processed data. The data transmission device is configured to transmit data from the accuracy ball. Examples of a data transmission device include a wireless transmitter, micro-USB port, external memory card port, etc. Transmitted data can also be termed exported data. Such data can be tracked, analyzed, graphed, and used to enhance learning; improve skill-sets; compare and/or contrast users, workouts, or training sessions; etc.

Figure 2:
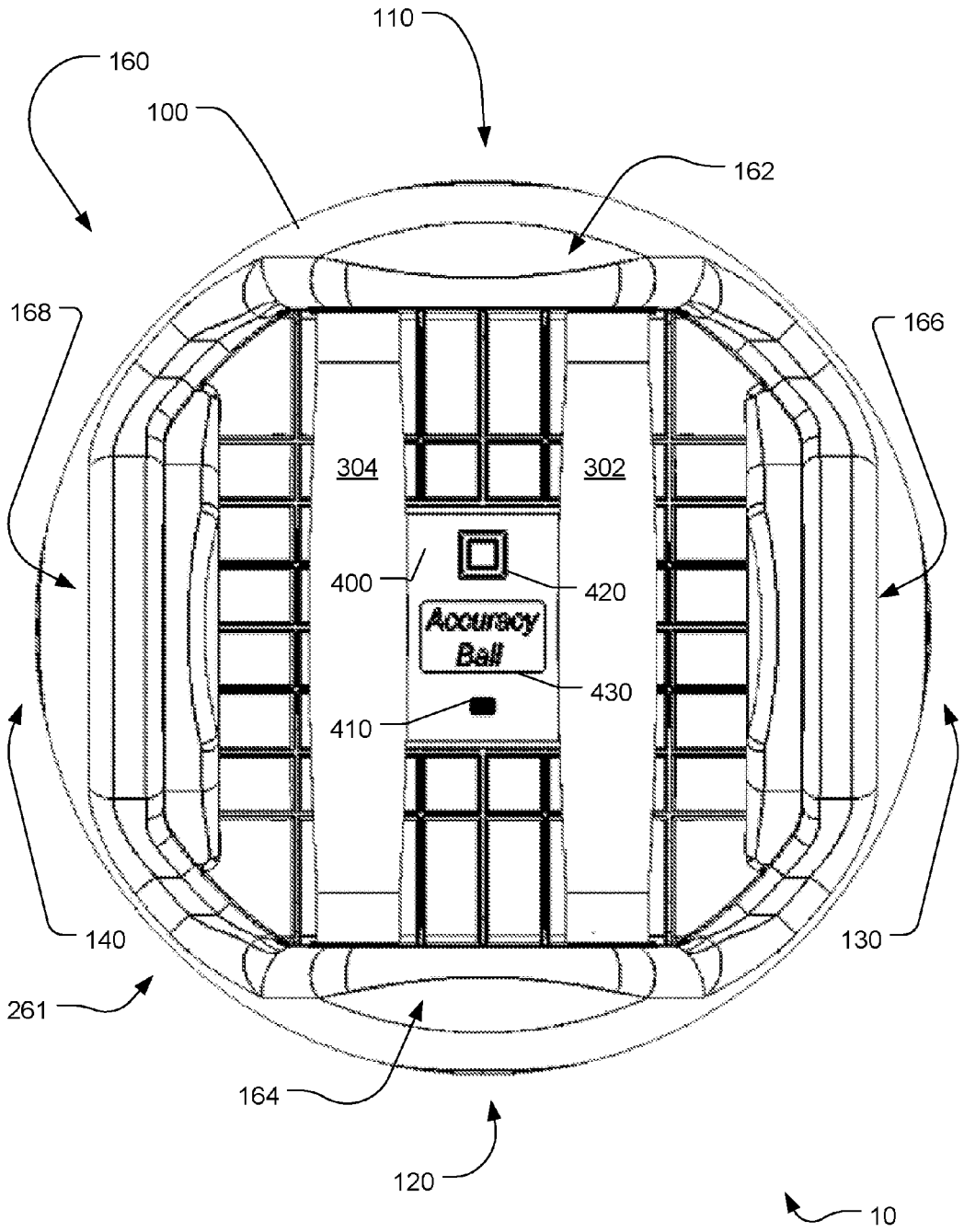
FIG. 2 illustrates a front elevation view of an exemplary embodiment of an accuracy ball.

FIG. 2 illustrates a front elevation view of an exemplary embodiment of an accuracy ball 10. In this view, the majority of the interior cavity 261 is visible. Located therein are the impact handles 302 and 304. Behind the handles, a data collection and processing core 400 can be positioned on the interior wall of the cavity 261. The core 400 can incorporate a plurality of input/output ports 410 and a plurality of switches 420. The IO ports 410 can allow manual connection of a wired external device for transfer of data in and out and updating software/programming in the core 400 as well. Such ports can accept memory cards, USB connections, wireless communication devices, etc. The plurality of switches can include an on switch, an off switch (or a combination of the two), a program switch, a change workout switch, etc. A display 430 can be as simple as an indicia of the device name, or as complex as a touch screen display such as those commonly found on smart phones, or anything in between. Readouts of time, date, temperature, workout length, user name, trainer name, etc. as well as information concerning strikes can be displayed. Additional components that comprise the core can include all of the electronics as described above. Since the individual components are well known in the art, they can be represented simply by the depiction of the core 400.

The core 400 can also contain or control a plurality of visual indicators and/or audio production devices. For example, the accuracy ball can emit light whenever the core 400 determines that pre-determined conditions have been met. Various, levels, colors, and locations of light emissions can be integrated into the accuracy ball. For example, when a user strikes the accuracy ball within a certain distance from one of the target aim points, one or more lights and/or sounds can be emitted from the accuracy ball. Sounds can also include verbal commands to strike various aim points, increase or decrease striking force or speed, provide feedback as to the correctness of strikes, etc.

Figure 3:
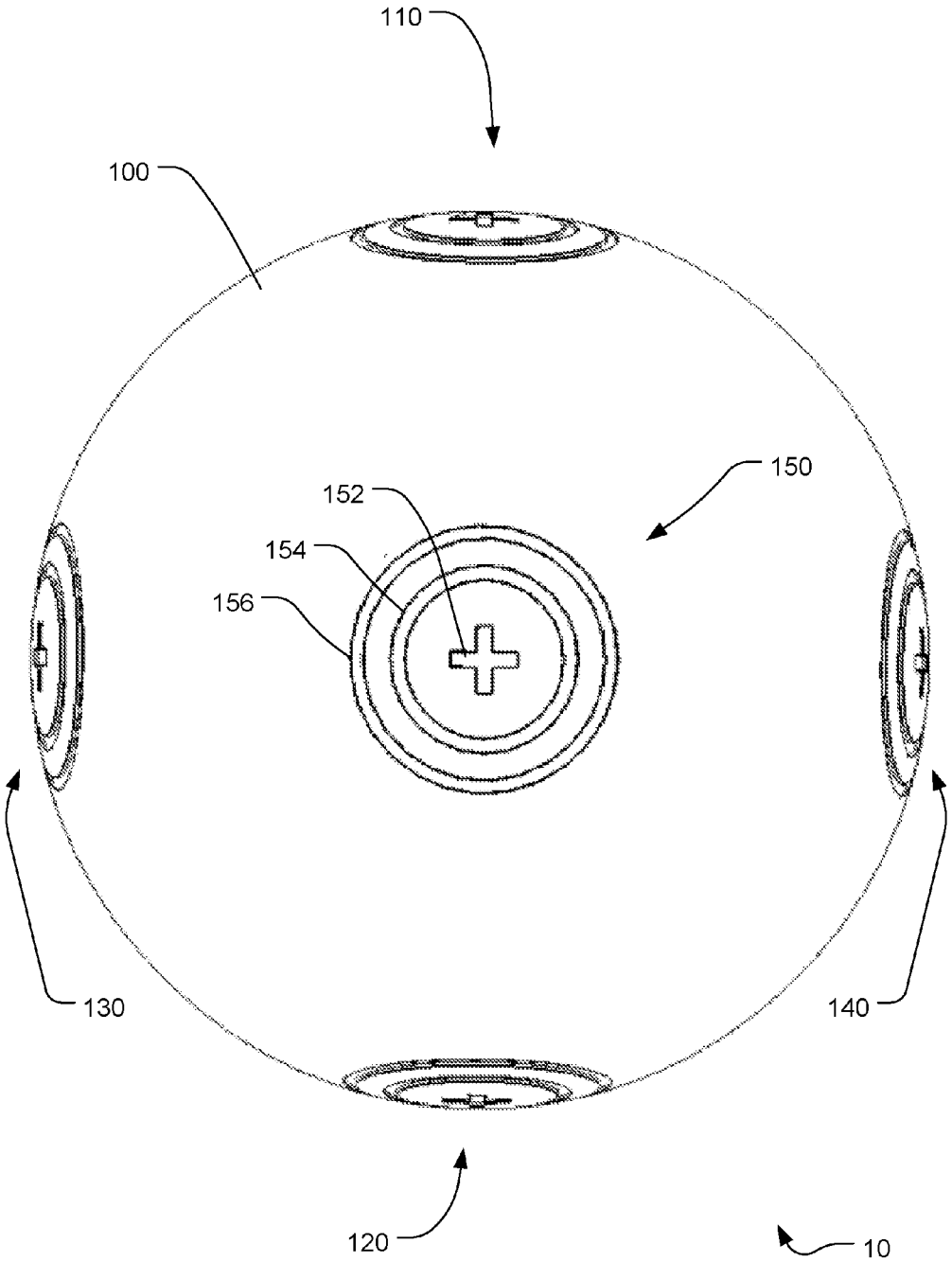
FIG. 3 illustrates a rear elevation view of an exemplary embodiment of an accuracy ball.

FIG. 3 illustrates a rear elevation view of an exemplary embodiment of an accuracy ball 10. A plurality of target aim points 110, 120, 130, 140 and 150 are illustrated. The top target aim point 110 is located near the top of the accuracy ball 10. The bottom target aim point 120 is located near the bottom of the accuracy ball 10. The first side target aim point 130 is located on one side of the accuracy ball 10 and the second side target aim point 140 is located on the other side thereof. A rear target aim point 150 is located on the rear surface of the accuracy ball and generally faces the user (assuming the front surface is facing the trainer). Any useful target aim point shapes/designs can be utilized without departing from the scope of the invention. In the embodiment illustrated in FIG. 3, a plus sign indicates the fifth main aim 152 of the rear target aim point 150, with a fifth plurality of centering rings 154 and 156 there around. The other target aim points can comprise first through fourth main aim points and first through fourth pluralities of centering rings. In other embodiments, other sizes/shapes of main aim points and associated indicia are contemplated. Examples include crosshairs, bulls-eyes, Xs, dots, etc.

Figure 4:
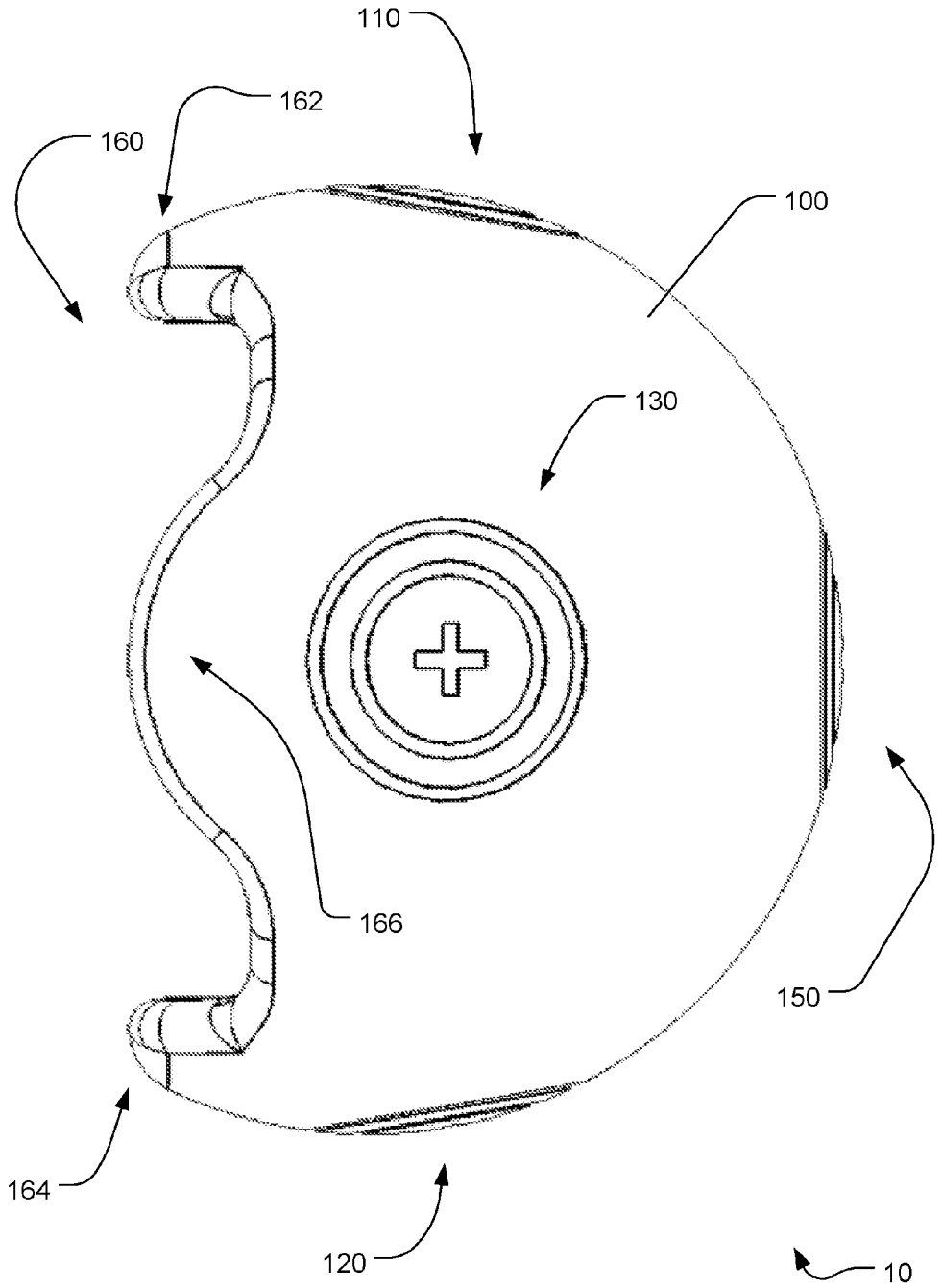
FIG. 4 illustrates a right side elevation view of an exemplary embodiment of an accuracy ball.
Figure 5:
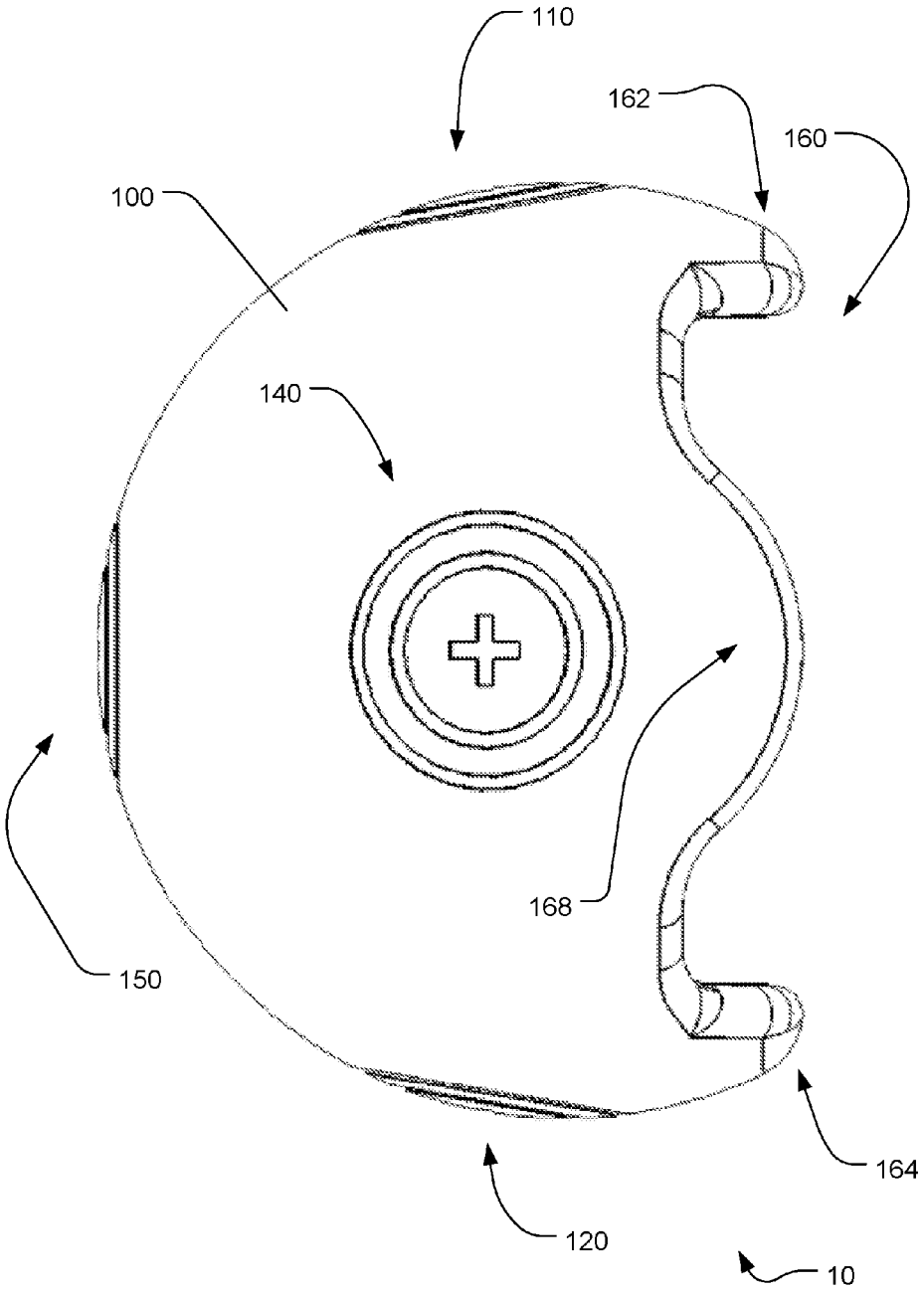
FIG. 5 illustrates a left side elevation view of an exemplary embodiment of an accuracy ball.

FIGS. 4 and 5 illustrate side elevation views of exemplary embodiments of an accuracy ball 10. The inward curl of the plurality of keeper lips 162, 164, 166, and 168 is illustrated more clearly in these views as is the relatively large opening that comprises the trainer access port 160.

Figure 6:
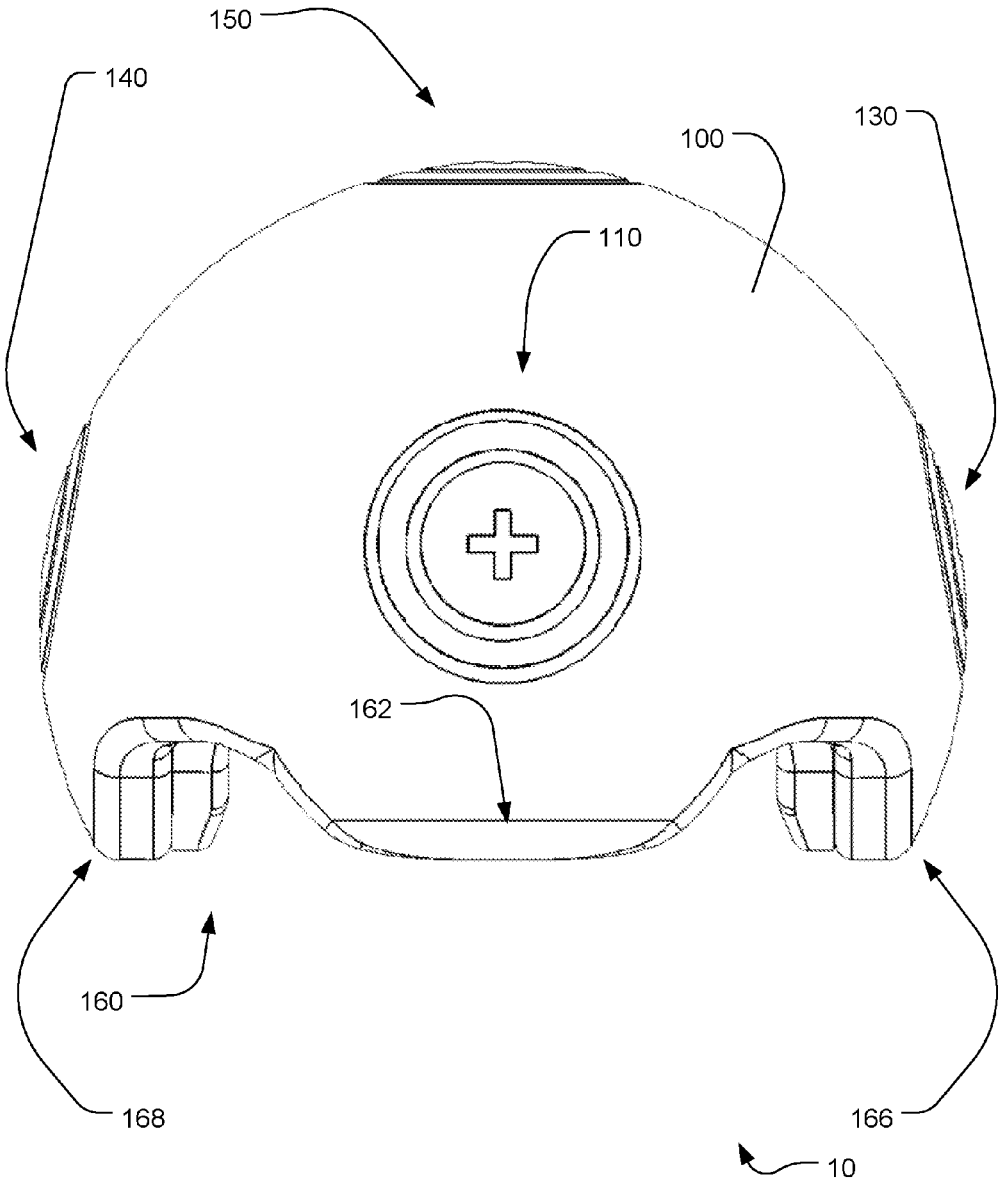
FIG. 6 illustrates a top plan view of an exemplary embodiment of an accuracy ball.
Figure 7:
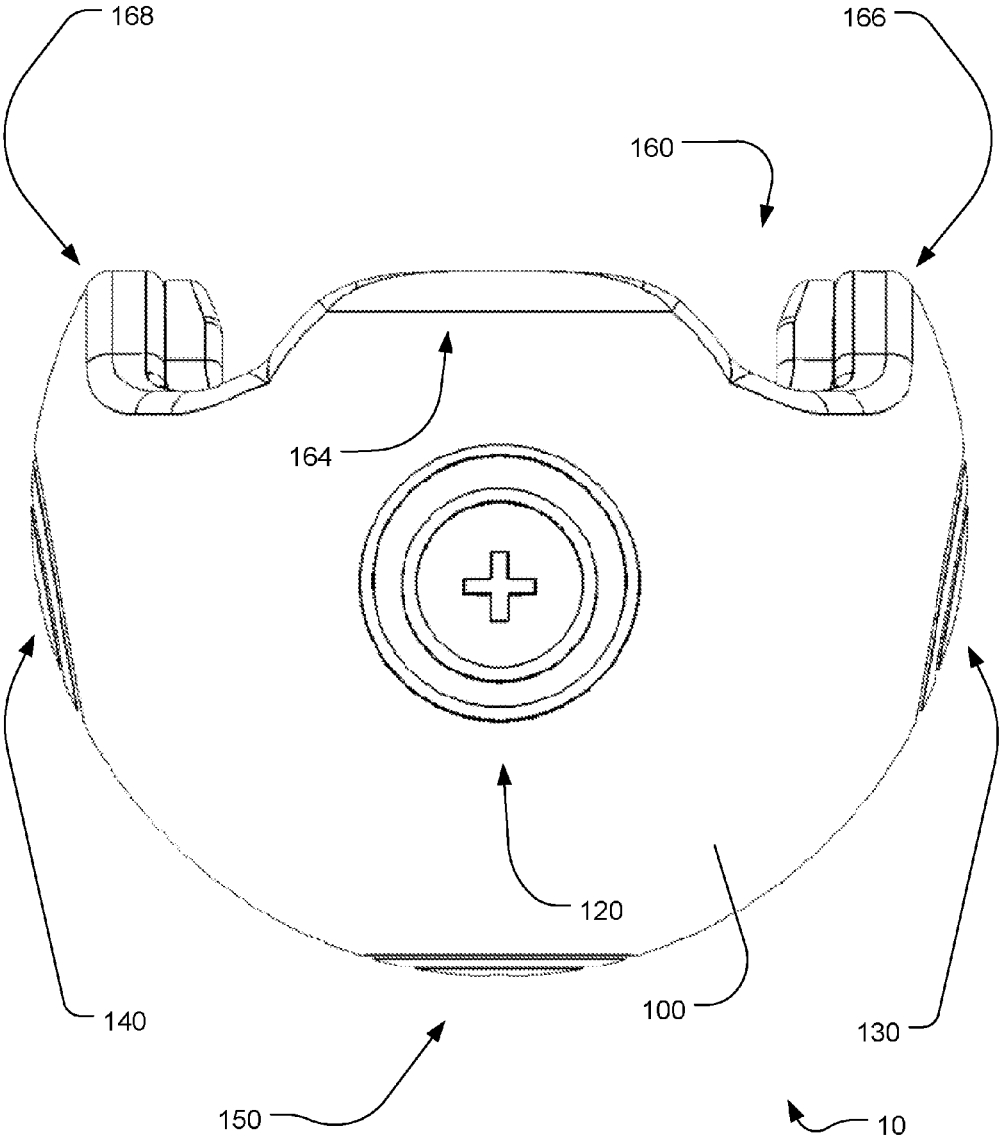
FIG. 7 illustrates a bottom plan view of an exemplary embodiment of an accuracy ball.

FIGS. 6 and 7 illustrate top and bottom plan views of exemplary embodiments of an accuracy ball 10. The inward curl of the plurality of keeper lips 162, 164, 166, and 168 is illustrated more clearly in these views as is the relatively large opening that comprises the trainer access port 160. Note that at least some of the plurality of target aim points 110, 120, 130, 140 and 150 are positioned slightly inwards from the cardinal direction points in the embodiments illustrated in the FIGS. In other embodiments, the number and locations of the plurality of target aim points can vary.

Figure 8:
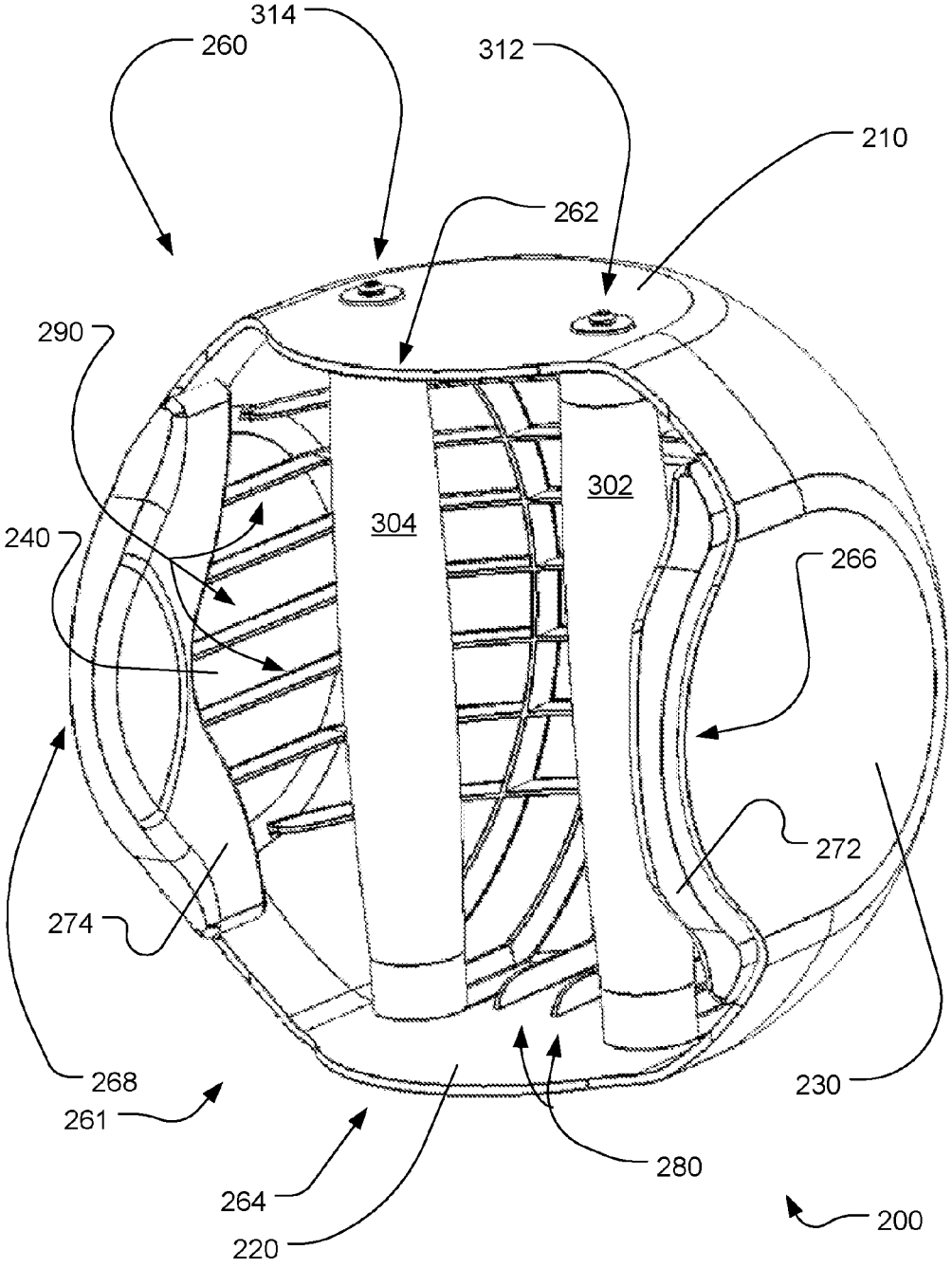
FIG. 8 illustrates a top and front perspective view of an exemplary embodiment of an accuracy ball with the strike target cover removed.

FIG. 8 illustrates a top and front perspective view of an exemplary embodiment of an accuracy ball 10 with the target strike cover 100 removed. In this view, some additional components are now visible. For example, a plurality of handle attachments 312 and 314 are shown connecting the plurality of impact handles 302 and 304 to the accuracy ball support structure 200. In other embodiments, other means of attaching the impact handles to the accuracy ball are contemplated.

A plurality of trainer wrist guards 272 and 274 are illustrated. They are designed to protect the trainer's wrists from any impact from the plurality of side structure lips 266 and 268. These side structure lips 266 and 268 and top/bottom structure lips 262 and 264 are designed to fit snugly within the plurality of keeper lips 162, 164, 166, and 168 such that the accuracy ball support structure 200 is maintained snugly within the target strike cover 100. The side and top/bottom structure lips comprise a perimeter of a second trainer access port 260 that provides access through the accuracy ball support structure 200 into the cavity 261.

A plurality of vertical support ribs 280 is visible on the interior surface of the cavity 261. Also, a plurality of horizontal support ribs 290 is visible as well. These are designed to strengthen the accuracy ball support structure 200 and the overall accuracy ball device 10 itself.

A plurality of impact sensor plates 210, 220, 230, and 240 can be incorporated in the accuracy ball support structure 200. Such impact sensor plates can sense the location, force, speed, and/or direction of impacts. In other embodiments the number and/or location of sensors can vary.

Figure 9:
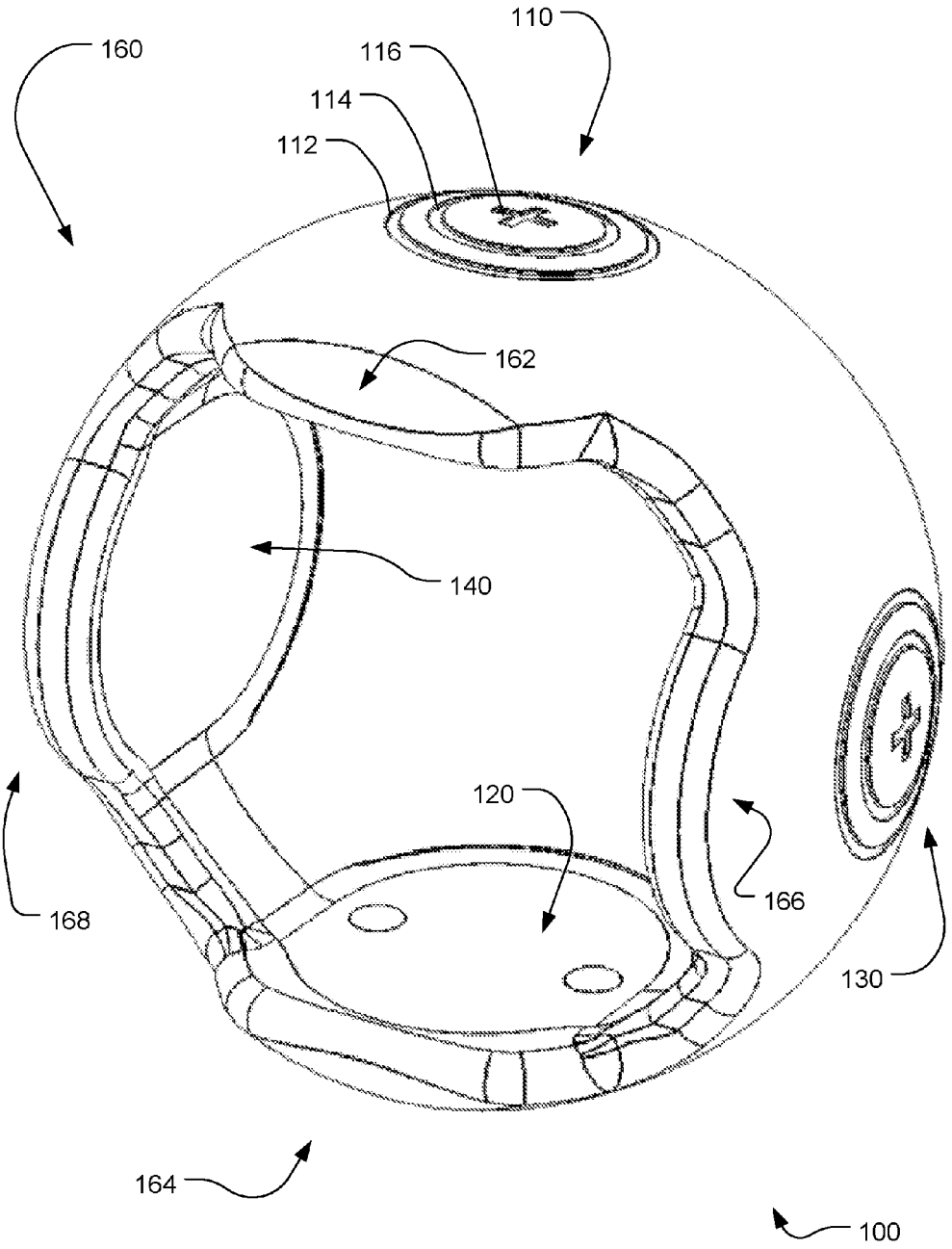
FIG. 9 illustrates a top and front perspective view of an exemplary embodiment of a strike target cover of an accuracy ball.

FIG. 9 illustrates a top and front perspective view of an exemplary embodiment of a target strike cover 100 of an accuracy ball. The accuracy ball is illustrated without the accuracy ball support structure 200 and other associated components, so that the interior of the target strike cover 100 is more visible. Note the interior of the cover 100 is shaped to snugly fit over the exterior of the support structure 200 so that the two join snugly together. Such snug fit helps to minimize relative motion between the two during use.

While particular embodiments have been described and disclosed in the present application, it is clear that any number of permutations, modifications, or embodiments may be made without departing from the spirit and the scope of this disclosure.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventor. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the disclosure.

What is claimed is:

1. An accuracy ball, comprising:

a target strike cover having an external surface and an internal surface;

the target strike cover having a plurality of specific target aim points on the external surface, the target aim points adapted to provide specific aiming points for a user's strikes;

the target strike cover further adapted to provide impact absorption such that the user is able to repeatedly strike the target strike cover safely;

the target strike cover having a first trainer access port through the external surface and providing access to the internal surface of the target strike cover, the first trainer access port bridging between the external surface and the internal surface;

an accuracy ball support structure having an outer surface and an inner surface, at least a portion of the outer surface of the support structure is at least one of removably attached and affixed to at least a portion of the internal surface of the target strike cover;

the support structure having a second trainer access port bridging between the outer surface and the inner surface and at least partially aligned with the first trainer access port;

a plurality of impact handles attached to the inner surface of the accuracy ball support structure;

the plurality of impact handles adapted to provide a grasping location for a trainer to grasp so as to be able to present the accuracy ball to the user;

the inner surface of the accuracy ball support structure being at least partially concave such that an inner cavity is defined as a space at least partially enclosed thereby;

the external surface of the target strike cover extending to at least partially surround the impact handles so that the impact handles are shielded from at least frontal and side user strikes by the external surface of the target strike cover;

the accuracy ball having therein a data collection and processing core;

the data collection and processing core containing at least a processor, a data receiving device and a data transmission device;

a plurality of sensors selected from at least force plates and accelerometers configured to gather data concerning any strikes sustained by the accuracy ball, the plurality of sensors in electronic communication with the data receiving device, at least one of the plurality of sensors located within at least one of the target strike cover, the support structure, the impact handles, and the data collection and processing core;

the processor configured to process data from the data receiving device, the processor in electronic communication with the data transmission device; and the data transmission device configured to transmit data from the accuracy ball.

2. The accuracy ball of claim 1, wherein the target strike cover further comprises:

a plurality of keeper lips comprising at least a portion of a first perimeter of the first trainer access port, the plurality of keeper lips adapted to removably wrap around at least a portion of a second perimeter of the second trainer access port in order to secure the accuracy ball support structure within the target strike cover.

3. The accuracy ball of claim 1, further comprising:

a plurality of trainer wrist guards located between the plurality of impact handles and at least one side portion of at least one of the first trainer access port and the second trainer access port.

4. The accuracy ball of claim 2, further comprising:

a plurality of trainer wrist guards located between the plurality of impact handles and at least one side portion of at least one of the first trainer access port and the second trainer access port.

5. The accuracy ball of claim 1, further comprising:

a switch configured to turn on data collection and processing functions of the accuracy ball.

6. The accuracy ball of claim 2, further comprising:

a switch configured to turn on data collection and processing functions of the accuracy ball.

7. The accuracy ball of claim 3, further comprising:

a switch configured to turn on data collection and processing functions of the accuracy ball.

8. The accuracy ball of claim 4, further comprising:

a switch configured to turn on data collection and processing functions of the accuracy ball.

9. The accuracy ball of claim 1, wherein the plurality of sensors include at least one impact sensor plate located in proximity to each target aim point and configured to sense strikes in proximity thereto.

10. The accuracy ball of claim 2, wherein the plurality of sensors include at least one impact sensor plate located in proximity to each target aim point and configured to sense strikes in proximity thereto.

11. The accuracy ball of claim 3, wherein the plurality of sensors include at least one impact sensor plate located in proximity to each target aim point and configured to sense strikes in proximity thereto.

12. The accuracy ball of claim 4, wherein the plurality of sensors include at least one impact sensor plate located in proximity to each target aim point and configured to sense strikes in proximity thereto.

13. The accuracy ball of claim 5, wherein the plurality of sensors include at least one impact sensor plate located in proximity to each target aim point and configured to sense strikes in proximity thereto.

14. The accuracy ball of claim 6, wherein the plurality of sensors include at least one impact sensor plate located in proximity to each target aim point and configured to sense strikes in proximity thereto.

15. The accuracy ball of claim 7, wherein the plurality of sensors include at least one impact sensor plate located in proximity to each target aim point and configured to sense strikes in proximity thereto.

16. The accuracy ball of claim 8, wherein the plurality of sensors include at least one impact sensor plate located in proximity to each target aim point and configured to sense strikes in proximity thereto.

17. The accuracy ball of claim 1, wherein the plurality of target aim points include at least a front target aim point comprising an indicia indicating a first main aim and a first plurality of centering rings there around.

18. The accuracy ball of claim 4, wherein the plurality of target aim points include at least a front target aim point comprising an indicia indicating a first main aim and a first plurality of centering rings there around.

19. The accuracy ball of claim 8, wherein the plurality of target aim points include at least a front target aim point comprising an indicia indicating a first main aim and a first plurality of centering rings there around.

20. The accuracy ball of claim 16, wherein the plurality of target aim points include at least a front target aim point comprising an indicia indicating a first main aim and a first plurality of centering rings there around.

* * * * *